United States Patent [19]

Iida

[11] Patent Number: 4,913,112

[45] Date of Patent: Apr. 3, 1990

[54] POWER TOOL

[75] Inventor: Giichi Iida, Tokyo, Japan

[73] Assignee: Kioritz Corporation, Tokyo, Japan

[21] Appl. No.: 294,298

[22] Filed: Jan. 6, 1989

[30] Foreign Application Priority Data

Jan. 8, 1988 [JP] Japan ..... 63-559[U]
Jan. 8, 1988 [JP] Japan ..... 63-560[U]
Jan. 14, 1988 [JP] Japan ..... 63-3264[U]

[51] Int. Cl.[4] ..... F02B 77/00

[52] U.S. Cl. ..... 123/198 E; 123/41.65; 123/179 SE; 123/195 R; 15/327 C; 15/410; 415/206; 173/170

[58] Field of Search ..... 123/179 SE, 195 C, 195 R, 123/195 E, 195 H, 198 E, 41.65, 41.66; 415/121.2, 204, 206; 30/381, 382, 383; 15/327 C, 330, 344, 405, 410, 422; 173/170

[56] References Cited

U.S. PATENT DOCUMENTS

| | | | |
|---|---|---|---|
| 3,844,360 | 10/1974 | Green et al. | 173/170 |
| 4,223,419 | 9/1980 | Sato et al. | 15/327 C |
| 4,517,939 | 5/1985 | Kiyooka | 123/198 E |
| 4,644,606 | 2/1987 | Luerken et al. | 15/330 |
| 4,756,668 | 7/1988 | Gassen et al. | 15/422 |

*Primary Examiner*—Noah P. Kamen
*Attorney, Agent, or Firm*—Browdy & Neimark

[57] ABSTRACT

A power tool comprises a throttle lever pivotally provided at a rear end portion of a handle and extending inside the handle toward a front end portion of the handle; a finger engaging portion formed at the front end portion of the throttle lever in such a manner as to project from the handle to the outside; wherein a rear-end portion of the throttle lever is connected with a throttle valve of the internal combustion engine by means of a connecting member, and, when the throttle valve is at an idling position, the finger engaging portion of the throttle lever is held at a position where the finger engaging portion projects from the handle to the outside.

3 Claims, 6 Drawing Sheets

POWER TOOL

BACKGROUND OF THE INVENTION

The present invention relates to a power tool such as a power blower, which uses an internal combustion engine as a power source.

As an example of a power tool of the type described above, a power blower is so arranged that a blower and an internal combustion engine for driving the blower are provided in a body. The internal combusion engine is covered with a cover, and the user effects a cleaning operation or the like by means of air flowing out from the blower, while carrying the power blower by holding a handle formed on the cover. When increasing the output of the internal combusion engine during use, the user operates a throttle lever with a finger to increase the amount of opening of the throttle valve. With a conventional power blower, however, it is hard to increase the lever ratio of the throttle lever to a large degree, so that the throttle lever must be operated with relatively large forces applied to the finger. Hence, there has been drawbacks in that the engine control can become inaccurate, and the finger become stiff, thereby imparting a deteriorated feeling of control to the user.

In addition, an electric wire extending from an ignition device to an ignition plug has hitherto been retained with respect to the cover by a retainer which is secured to the cover by such fixing means as screwing. For this reason, the retainer for retaining the electric wire and fixing means therefor have been required, and a process for fixing the retainer to the cover has been required. For this reason, the number of parts used in the power blower is disadvantageously numerous, so that there has been a drawback in that assembly thereof is time-consuming and troublesome.

Furthermore, since the bottom of the power blower is generally formed in such a manner as to be curved into a tubular shape in correspondence with the configuration of the blower cover, when the power blower is seated on a flat surface such as the ground surface, the body cannot be seated well, and is seated unstably. To obviate this problem, a conventional power blower is provided with a seating member or a stand at its bottom so as to allow the power blower to be seated stably. However, since parts including the seating member or the stand are required, there have been drawbacks in that an assembly process for installing such parts is required, and such parts mar the beauty of the external design of the power blower.

SUMMARY OF THE INVENTION

Accordingly, an object of the present invention is to provide a power tool which has a simple structure and has a configuration for facilitating use thereof, thereby overcoming the above-described drawbacks of the prior art.

To this end, in accordance with one aspect of the invention, there is provided a power tool in which a body provided with an internal combusion engine is covered with a cover and a handle is formed on an upper portion of the cover, the power tool comprising: a throttle lever pivotally provided at a rear end portion of the handle and extending inside the handle toward a front end portion of the handle; a finger engaging portion formed at the front end portion of the throttle lever in such a manner as to prodect from the handle to the outside; wherein a rear-end portion of the throttle lever is connected with a throttle valve of the internal combusion engine by means of a connecting member, and, when the throttle valve is at an idling position, the finger engaging portion of the throttle lever is held at a position where the finger engaging portion projects from the handle to the outside.

In accordance with another aspect of the invention, there is provided a power tool in which a body provided with an internal combustion engine is covered with a cover and a handle is formed on an upper portion of the cover, wherein the internal combistion engine is adapted to drive a blower, the cover is constituted by a pair of cover portions formed with a vertically split structure, an electric wire retainer which has an overall U-shaped configuration, one side portion of which is unitedly formed with a cylinder cover portion of one cover portion, and which is arranged to be easily withdrawable from a mold at the time of the molding of the cylinder cover, and an electric wire connected to an ignition plug of the internal combusion engine is clamped and retained by the wire retainer.

In accordance with still another aspect of the invention, there is provided a power tool in which a body provided with an internal combustion engine is covered with a cover and a handle is formed on an upper portion of the cover, wherein the internal combustion engine is adapted to drive a blower, a laterally projecting portion is formed integrally at a lower end portion of the cover, a flat and continuous bottom wall portion with a substantially large area is formed on the cover and the laterally prodjecting portion, a plurality of reinforcing ribs are formed between the laterally projecting portion and an internal side wall portion of the cover, an opening which is open to the outside is formed at a side portion of the laterally projecting portion, and a fuel tank is mounted on the laterally projecting portion via the opening.

The above and other objects, features and advantages of the present invention will become more apparent from the following detailed description of the invention when read in conjunction with the accompanying drawings.

PREFERRED EMBODIMENTS OF THE INVENTION

Referring now to the accompanying drawings, description will be given of the preferred embodiments of the invention.

Figure 1:
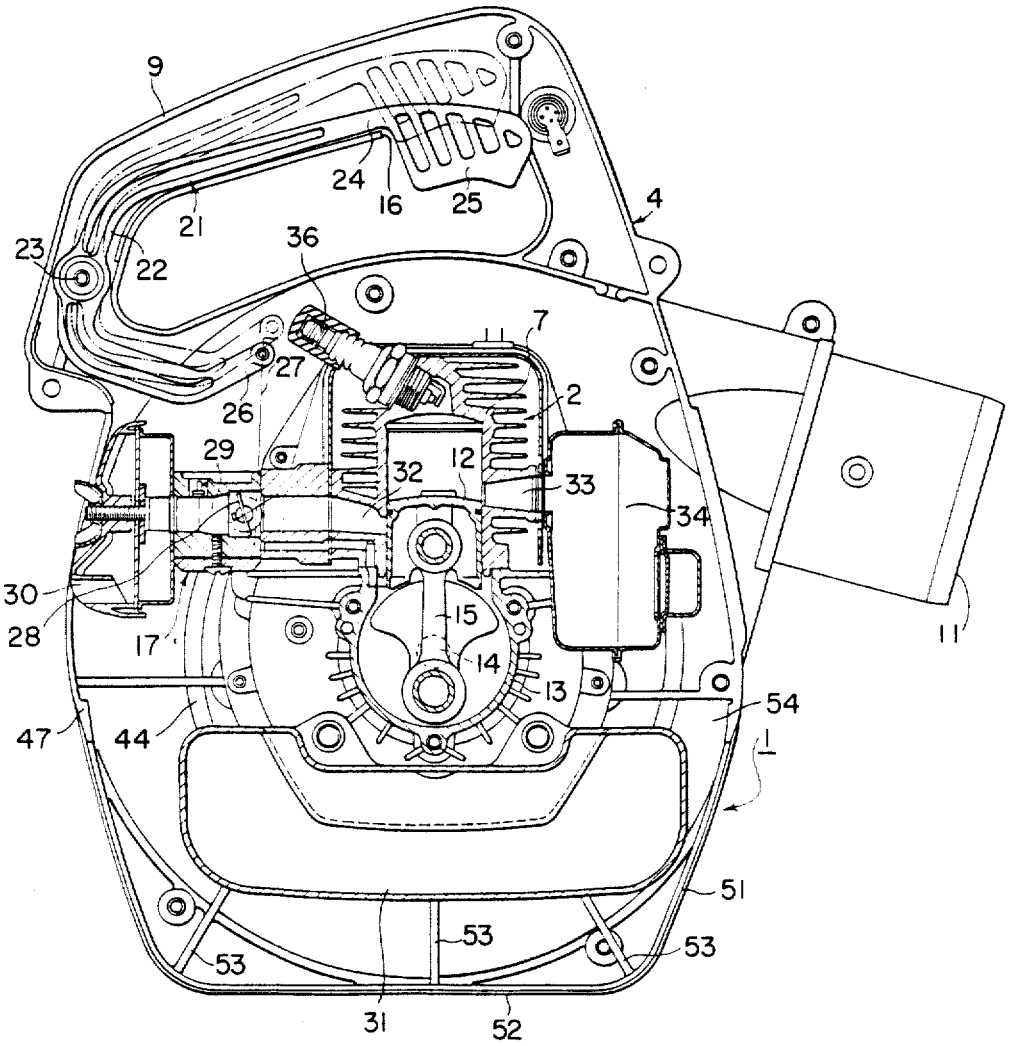
FIG. 1 is a vertical cross-sectional view illustrating an embodiment of the present invention.
Figure 2:
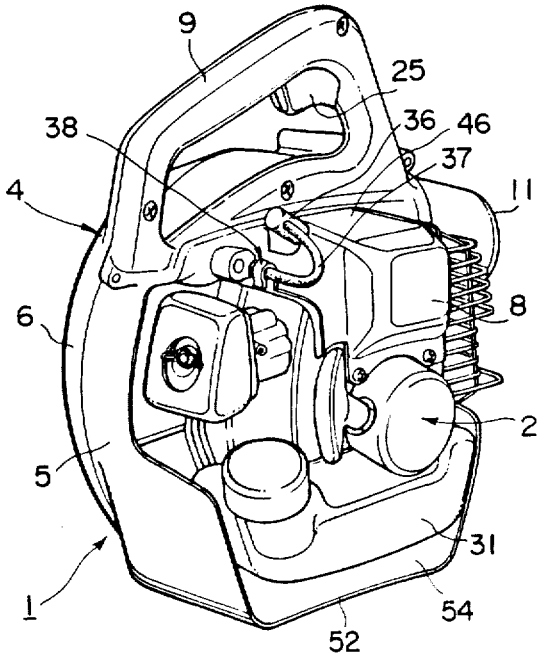
FIG. 2 is a perspective view of FIG. 1.
Figure 3:
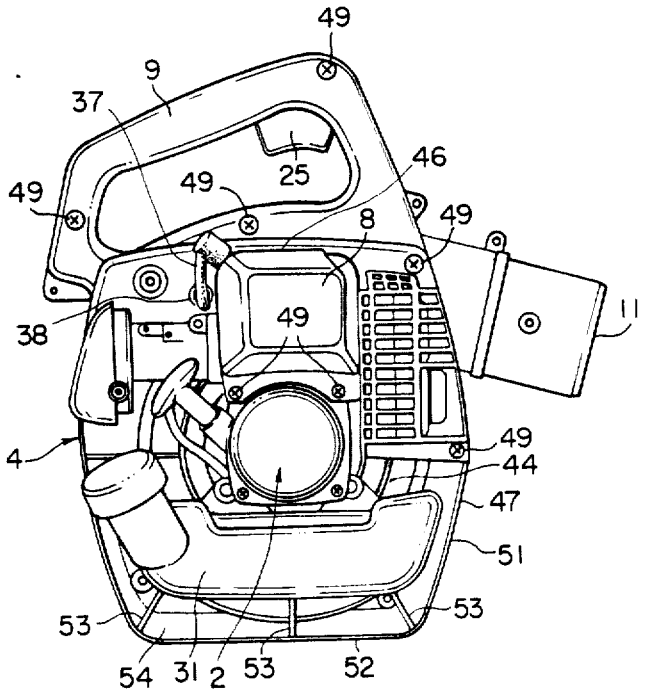
FIG. 3 is a right-hand side elevational view.

As shown in FIGS. 1, 2 and 3, a power blower which is a power tool in accordance with an embodiment of the present invention is so arranged that an internal combustion engine 2 is provided in a body 1 in the vicinity of one side thereof, and a blower fan 3 is provided in the vicinity of the other side of the body 1. In addition, a cover 4 is provided on the body 1, and the cover 4 comprises right- and left-hand cover portions 5, 6 formed of a plastic or the like in such a manner as to divide the cover 4 vertically into two halves. The right-hand cover portion 5 has on a side portion thereof a cylinder cover 8 formed integrally therewith to cover a cylinder 7 of the internal combustion engine 2. The two cover portions 5, 6 respectively have halves of a hollow handle 9 formed integrally at upper joint portions thereof, these halves being coupled together to form the handle 9 to be held by the user. The left-hand cover portion 6 is formed in such a manner as to cover the blower fan 3, and an air intake port 10 for introducing the air into the blower fan 3 is formed at a central portion thereof. The air flowing in from this port 10 is pressurized by the blower fan 3 and is discharged from a discharge port 11 formed by combining portions of the right- and left-hand cover portions 5, 6 at the front portion of the body 1. By making use of the flow of this discharged air, the user is able to perform a cleaning operation or the like.

A piston 12 is provided in the cylinder 7 of the internal combusion engine 1 in such a manner as to be vertically reciprocatable, and a crankcase 13 is connected to a lower portion of the cylinder 7. A crankshaft 14 with the blower fan 3 coupled directly with one end thereof is supported rotatably, the crank-shaft 14 being coupled with the piston 12 via a connecting rod 15.

The handle 19 incorporates therein a synthetic resin-made throttle lever 21 which has adequate resiliency and extends back and forth in conformity with the configuration of the handle 9 and the rear-end portion of which is bent into a U-shape. At its intermediate curved portion 22, the throttle lever 21 is supported by a pivot 23 installed in a rear portion of the handle 9, in such a manner as to be vertically pivotable. An upper front end portion 24 of the throttle lever 21 extending long from the pivot 23 has a finger engaging portion 25 which is formed integrally therewith at and projecting downward to the outside from a slot 16 provided in the longitudinal direction in the lower joint portions of the handle 9. A lower rear-end portion 26 of the throttle lever 21, which is bent toward the front and has a short length, is disposed in the vicinity of the upper end of the interior of the body 1 and is connected to a throttle valve 28 of a carburetor 17 by means of a connecting member 17 such as a linkage rod. The throttle valve 28 is provided pivotally in a venturi 29 of the carburetor 17, is constantly biased by a spring (not shown) to an idling position for maintaining an amount of opening necessary for maintaining an idling state of the internal combustion engine 2 and is normally held at that position. For this reason, the throttle lever 21 is normally located at the position indicated by the solid line in FIG. 1, and the finger engaging portion 25 of the aforementioned upper front end portion 24 of the throttle lever 21 is maintained at its position projecting downward from the handle 9. The carburetor 17 mixes therein the air introduced from an air inlet 30 as well as fuel supplied from a fuel tank 31, and this air-fuel mixture is regulated by the throttle valve 28, and is supplied from an intake port 32 of the cylinder 7 into the cylinder 7.

When the output of the internal combustion engine 2 is to be increased to operate the blower fan 3, the user pulls the finger engaging portion 25 of the throttle lever 21 upwardly with the forefinger of the hand which holds the handle 9 so as to pivotally move the throttle lever 21 toward the operating position shown by phantom line in FIG. 1. At this juncture, even if the finger engaging portion 25 is pulled up to the position where the finger engaging portion 25 is completely accommodated in the handle 9, since the throttle lever 21 has a buffer effect, the user is capable of performing the operation by holding the handle 9 with a good feeling. Thus, the throttle valve 28 is pivotally moved via the connecting member 27 in opposition to the action of the spring and its amount of opening is increased to increase the amount of air-fuel mixture sent to the cylinder 7 of the internal combustion engine 2, resulting in an increased engine output. The combustion exhaust gas in the cylinder 7 is discharged to the outside through an exhaust port 33 of the cylinder 7 via a muffler 34. When the internal combustion engine 2 is returned to an idling state, if the forefinger is released from the finger engaging portion 25, the throttle valve 28 is returned to its original idling position by means of the action of the spring, and, at the same time, returns the throttle lever 21 via the connecting member 27 to the idling position indicated by the solid line in FIG. 1. Since the throttle lever 21 is disposed in such a manner as to extend longitudinally of the handle 9 from the pivot 23 in the rear-end portion inside the handle 9 toward the front end portion thereof, as described above, it is possible to increase the lever ratio. For this reason, it is possible to accurately control the output of the internal combustion engine 2 with a small force, and the control feeling imparted to the user can be ameliorated.

In addition, the cylinder 7 has an ignition plug 36 installed on a head portion thereof, and the ignition plug 36 receives an electric current in such a manner as to generate a spark at an internal end thereof to ignite and burn the air-fuel mixture introduced into the cylinder 7.

A magneto-type ignition device (not shown) for generating an electric current supplied to the ignition plug 36 generates electricity by a magnet provided on a rotor which is connected to the crankshaft 14 and is rotated thereby and a power generating coil fixed to the body 1 adjacent to this magnet. The magneto-type ignition device supplies the current to the ignition coil via an electronic circuit. A secondary winding of this ignition coil is connected to an external end of the ignition plug 36 by means of a high-tension resistant electric wire 37.

Figure 7:
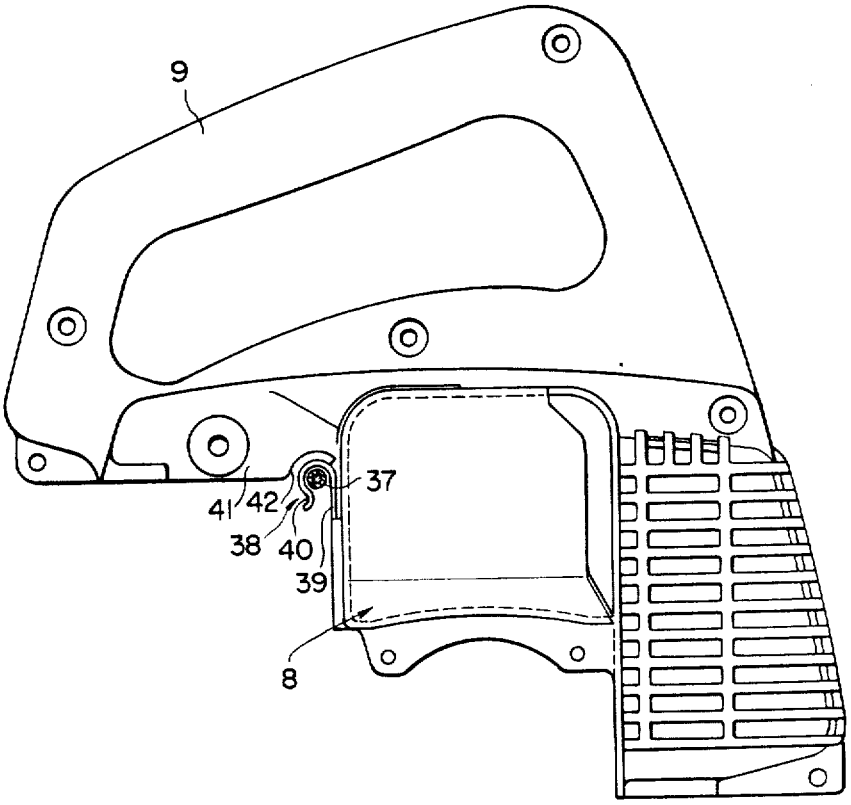
FIG. 7 is an enlarged side elevational view of a cylinder cover.

The cylinder cover 8 has an integrally formed electric wire retainer 38 at an external portion thereof where the wire extends. As shown clearly in FIG. 7, the wire retainer 38 has an overall U-shaped configuration, and is connected integrally at one side portion 39 thereof with the cylinder cover 8, while the other side portion 40 of the wire retainer 38 is adapted to be pushed widely resiliently away from the one side portion 39. Furthermore, to ensure that the wire retainer 38 can be formed integrally with the cylinder cover 8 during molding thereof and can be removed readily from a mold, the wire retainer 38 is provided with a cutout portion 42 at a handle-side wall portion 41 of the cylinder cover 8 in the illustrated example.

When the wire 37 is clamped and retained by the wire retainer 38 thus arranged, the wire 37 is pushed upward through a lower opening of the U-shaped wire retainer 38 to hold between the one side portion 39 and the other side portion 40. At that time, the other side portion 40 receives the wire 37 while expanding slightly outward, and retains the wire 37 to the position shown in FIG. 7 by means of its resiliency.

Figure 5:
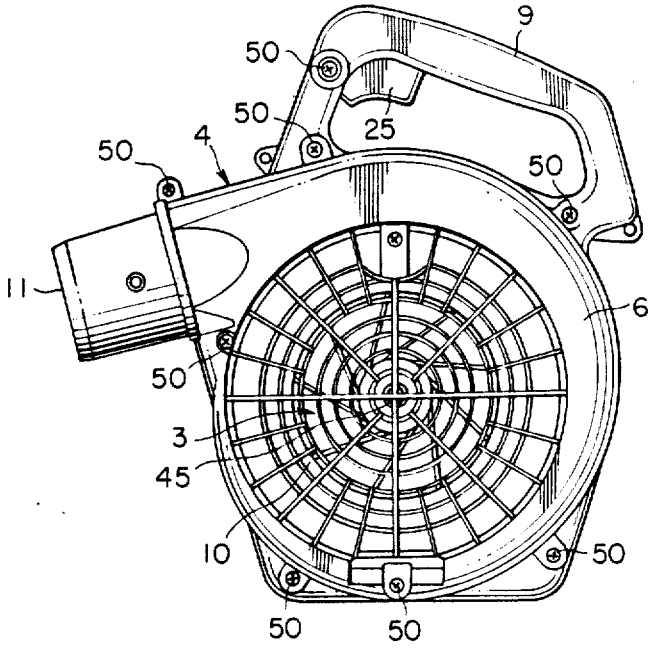
FIG. 5 is a left-hand side elevational view.

Furthermore, as shown in FIG. 1, the internal combustion engine 2 is arranged such that its cylinder 7 is located at an upper portion of the interior of the cover 4, and the crankcase 13 is disposed underneath the cylinder 7. The crankcase 13 is disposed substantially in the center of the cover 4, is secured by an internal wall portion 44, and rotatably supports the crankshaft 14. The crankshaft 14 is connected to and driven by the piston 12 which reciprocates vertically inside the cylinder 7, by means of the connecting rod 15. The crankshaft 14 is connected to a fan shaft 45 (see FIG. 5) of the blower fan 3 so as to drive the blower fan 3.

Figure 4:
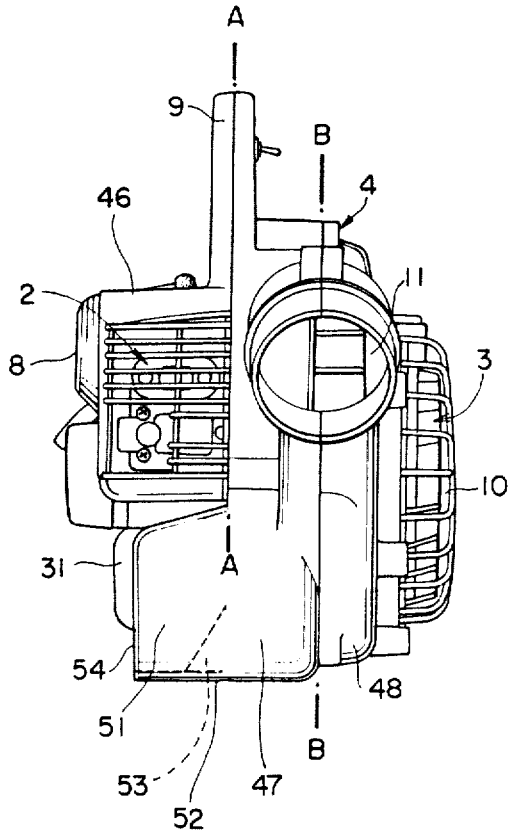
FIG. 4 is a front elevational view.

As can be seen from FIG. 4, the cover 4 comprises an engine cover 46 formed in such a manner as to cover the outer periphery of the internal combusion engine 2, a blower main cover 47 disposed adjacent to the engine cover 46 and formed in such a manner as to cover the outer periphery of the main portion of the blower fan 3, and a blower side cover 48 disposed at the side portion of the blower main cover 47 opposite to the engine cover 46 and formed in such a manner as to cover the side portion of the blower fan 3. The engine cover 46 and the blower main cover 47 are jointed to each other at a coupling plane A (see FIG. 4) which extends vertically and longitudinally of the engine, and are coupled with each other by means of a plurality of screws 49 (see FIG. 3) for securing the engine cover 46 and the blower main cover 47 by screwing. In addition, the blower main cover 47 and the blower side cover 48 are jointed to each other at a coupling plane B (see FIG. 4) which is substantially parallel with the aforementioned coupling plane A and are coupled with each other by means of a plurality of screws 50 (see FIG. 5) for securing the blower main cover 47 and the blower side cover 48 by screwing. The engine cover 46 has a size that allows the same to be coupled with an upper portion of the blower main cover 47 in such a manner that the lower end of the engine cover 46 terminates at an intermediate portion of the blower main cover 47.

Figure 6:
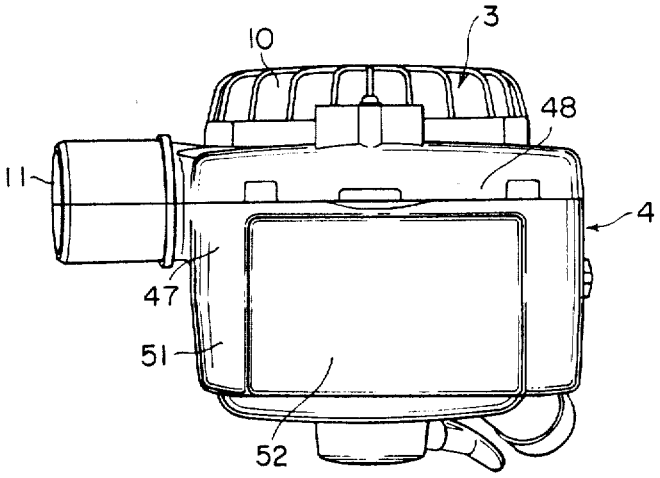
FIG. 6 is a bottom view.

The blower main cover 47 has at a lower end portion thereof an integrally formed laterally projecting portion 51 which projects laterally below the engine cover 46. The blower main cover 47 and the laterally projecting portion 51 have a flat, square, and continuous bottom wall portion 52 with a substantially large area which is formed integrally therewith, as shown in FIG. 6. A plurality of reinforcing ribs 53, which are formed integrally in such a manner as to extend between the bottom wall portion 52 and the internal wall portion 44 of the blower main cover 47, are provided on the laterally projecting portion 51 to reinforce the laterally projecting portion 51 and the bottom wall portion 52. The laterally projecting portion 51 has an opening 54 at a side portion thereof facing the outside. The fuel tank 31 can be mounted on the laterally projecting portion 51 through this opening 54. Thus, since the bottom wall portion 52 of the blower main cover 47 and the laterally projecting portion 51 are provided with a continuous and square-shaped, substantially large area, when the power blower is placed on a surface such as the ground surface, the bottom wall portion 52 can be seated on the surface, thereby making it possible to place the power blower stably.

The blower side cover 48 is provided with the relatively large air intake port 10 formed in a side surface thereof. In addition, the blower main cover 47 and the blower side cover 48 have the air discharge port 11 which is open in a tangential direction thereof. The left- and right-hand halves of air discharge port 11 are respectively formed by the blower main cover 47 and the blower side cover 48 with the coupling plane B as a boundary. The fan shaft 45 of the blower 3 is driven by driving force transmitted from the internal combustion engine 2. As a result, the outside air is introduced through the air intake port 10 into the blower fan 3, where the air is accelerated and pressurized so as to be discharged to the outside from the air discharge port 11. This discharged air current is used to effect a cleaning operation or the like.

The hollow handle 9, which extends back and forth rising above the engine cover 46 and the blower main cover 47, is formed integrally with the engine cover 46 and the blower main cover 47. The handle 9 is arranged in such a manner that left- and right-hand halves thereof are respectively formed by the engine cover 46 and the blower main cover 47 with the aforementioned coupling plane A as a boundary.

What is claimed is:

1. A power tool in which a body provided with an internal combusion engine is covered with a cover and a handle is formed on an upper portion of said cover, said power tool comprising:

a throttle lever pivotally provided at a rear end portion of said handle and extending inside said handle toward a front end portion of said handle;

a finger engaging portion formed at said front end portion of said throttle lever in such a manner as to project from said handle to the outside;

wherein a rear-end portion of said throttle lever is connected with a throttle valve of said internal combusion engine by means of a connecting member, and, when said throttle valve is at an idling position, said finger engaging portion of said throttle lever is held at a position where said finger engaging portion projects from said handle to the outside.

2. A power tool in which a body provided with an internal combustion engine is covered with a cover and a handle is formed on an upper portion of said cover, wherein said internal combustion engine is adapted to drive a blower, said cover is constituted by a pair of cover portions formed with a vertically split structure, an electric wire retainer which has an overall U-shaped configuration, one side portion of which is untitedly formed with a cylinder cover portion of one cover portion, and which is arranged to be easily withdrawable from a mold at the time of the molding of said cylinder cover, and an electric wire connected to an ignition plug of said internal combustion engine is clamped and retained by said wire retainer.

3. A power tool in which a body provided with an internal combustion engine is covered with a cover and a handle is formed on an upper portion of said cover, wherein said internal combusion engine is adapted to drive a blower, a laterally projecting portion is formed integrally at a lower end portion of said cover, a flat and continuous bottom wall portion with a substantially large area is formed on said cover and said laterally projecting portion, a plurality of reinforcing ribs are formed between said laterally projecting portion and an internal side wall portion of said cover, an opening which is open to the outside is formed at a side portion of said laterally projecting portion, and a fuel tank is mounted on said laterally projecting portion via said opening.

* * * * *